United States Patent [19]

Bally et al.

[11] Patent Number: 4,557,237

[45] Date of Patent: Dec. 10, 1985

[54] BYPASS RESTRICTOR FOR DISTRIBUTION VALVE

[75] Inventors: Fred R. Bally, East Peoria; Donald J. Waldman, Brimfield, both of Ill.

[73] Assignee: Caterpillar Tractor Co., Peoria, Ill.

[21] Appl. No.: 593,989

[22] Filed: Mar. 27, 1984

[51] Int. Cl.[4] ..... F02M 41/06

[52] U.S. Cl. ..... 123/450; 123/459

[58] Field of Search ..... 123/500, 449, 450, 457, 123/503, 502, 374, 364, 459; 417/270, 517

[56] References Cited

U.S. PATENT DOCUMENTS

| | | | |
|---|---|---|---|
| 2,815,741 | 12/1957 | Fancher et al. | 123/502 |
| 3,485,225 | 12/1969 | Bailey et al. | 123/450 |
| 4,376,432 | 3/1983 | Davis | 123/450 |
| 4,461,259 | 7/1984 | Roca-Nierga | 123/449 |
| 4,463,727 | 8/1984 | Babitzka et al. | 123/459 |

FOREIGN PATENT DOCUMENTS

| | | | |
|---|---|---|---|
| 246055 | 7/1963 | Australia | 123/450 |
| 799111 | 7/1958 | United Kingdom . | |
| 932829 | 7/1963 | United Kingdom . | |

*Primary Examiner*—Craig R. Feinberg
*Assistant Examiner*—David A. Okonsky
*Attorney, Agent, or Firm*—J. W. Burrows

[57] ABSTRACT

A bypass restrictor arrangement is provided for use in a distribution valve to control the rate of bypass flow thus effectively reducing cavitation in a fuel system at the end of the injection stroke. Others primarily rely on operation at low system pressure or they rely on a relief valve to maintain a predetermined pressure level in the bypass passage. In the subject arrangement, an orifice is located in a bypass port of a rotor prior to the bypass fluid communicating with a low pressure chamber. Furthermore, the low pressure chamber is maintained at a predetermined pressure level by a relief valve. This arrangement ensures that the rate of fuel flow during bypass is controlled while also flushing and/or controlling the size of any entrained air bubbles or voids thus increasing the efficiency of the fuel system.

9 Claims, 6 Drawing Figures

BYPASS RESTRICTOR FOR DISTRIBUTION VALVE

TECHNICAL FIELD

This invention relates generally to a distribution valve and more particularly to the control of the quantity of fuel delivered to the respective cylinder through the distribution valve.

BACKGROUND ART

Distributor valves for use in the distribution of fluid, such as fuel for diesel engines, are generally intended to control the quantity of fuel delivered to the respective cylinders. In order to control the quantity of fuel, it is common practice to provide a spill collar around a distribution rotor to selectively control the duration of fuel injection by bypassing fuel at a predetermined time interval of the injection stroke. The rate of flow of the bypassed fuel produces cavitation both in the distributor passages and also in the supply passage. Any cavitation in the fuel system drastically effects the performance of the engine, since cavitation creates areas of voids and entrained air bubbles in the fuel system. This cavitation is primarily caused by a rapid pressure loss in the passages of the rotor once the bypassing of fuel starts thus causing the passages to overdump. The collapse of the voids and compression of the air bubbles during the next pumping stroke results in insufficient quantities of fuel being delivered to the respective cylinders during subsequent injections. Furthermore, the collapse of the cavitated areas causes erosion on the surfaces between the rotor and collar.

One attempt of overcoming this problem is to provide a relief valve in the bypass line in order to provide a back pressure in the fuel lines. The use of the relief valve helps offset the size of the voids, but it is well known that once the pressure level of the relief valve is surpassed the relief valve opens totally, thus not effectively controlling the rate of bypass flow. Even though the higher relief setting helps to control the size of the voids, the higher relief setting hampers the ability of the system to efficiently perform during idle conditions when bypass flows are high.

The present invention is directed to overcoming one or more of the problems as set forth above.

DISCLOSURE OF THE INVENTION

In one aspect of the present invention, a distribution valve is provided. The distribution valve has a housing defining a bore and a plurality of distributor passages in communication with the bore. A rotor is located in the bore and is adapted to rotate. The rotor has a peripheral surface, an axial passage located therein adapted for selective communication with a source of pressurized fluid, and an outlet port communicating with the axial passage and adapted for selective communication with each of the plurality of distributor passages. A bypass port means is provided in communication with the axial passage and exits on the peripheral surface of the rotor. A bypass collar is disposed about a portion of the rotor and has a spill passage means to selectively communicate the bypass port means of the rotor with a low pressure chamber. The bypass collar is adjustably restrained from rotation relative to the rotor. A means is provided for restricting the flow of fluid from the axial passage to the low pressure chamber. A means is provided for controlling the pressure of fluid in the low pressure chamber to a predetermined level.

The present invention provides a distribution valve having a restricting means in the bypass line prior to the collar spill passage means and further includes a pressure control means to control the pressure level of the fluid in the low pressure chamber. This relationship controls the rate of bypass flow to the low pressure chamber and maintains a minimum pressure level in the chamber to effectively reduce cavitation in the distribution valve.

BEST MODE FOR CARRYING OUT THE INVENTION

Figure 1:
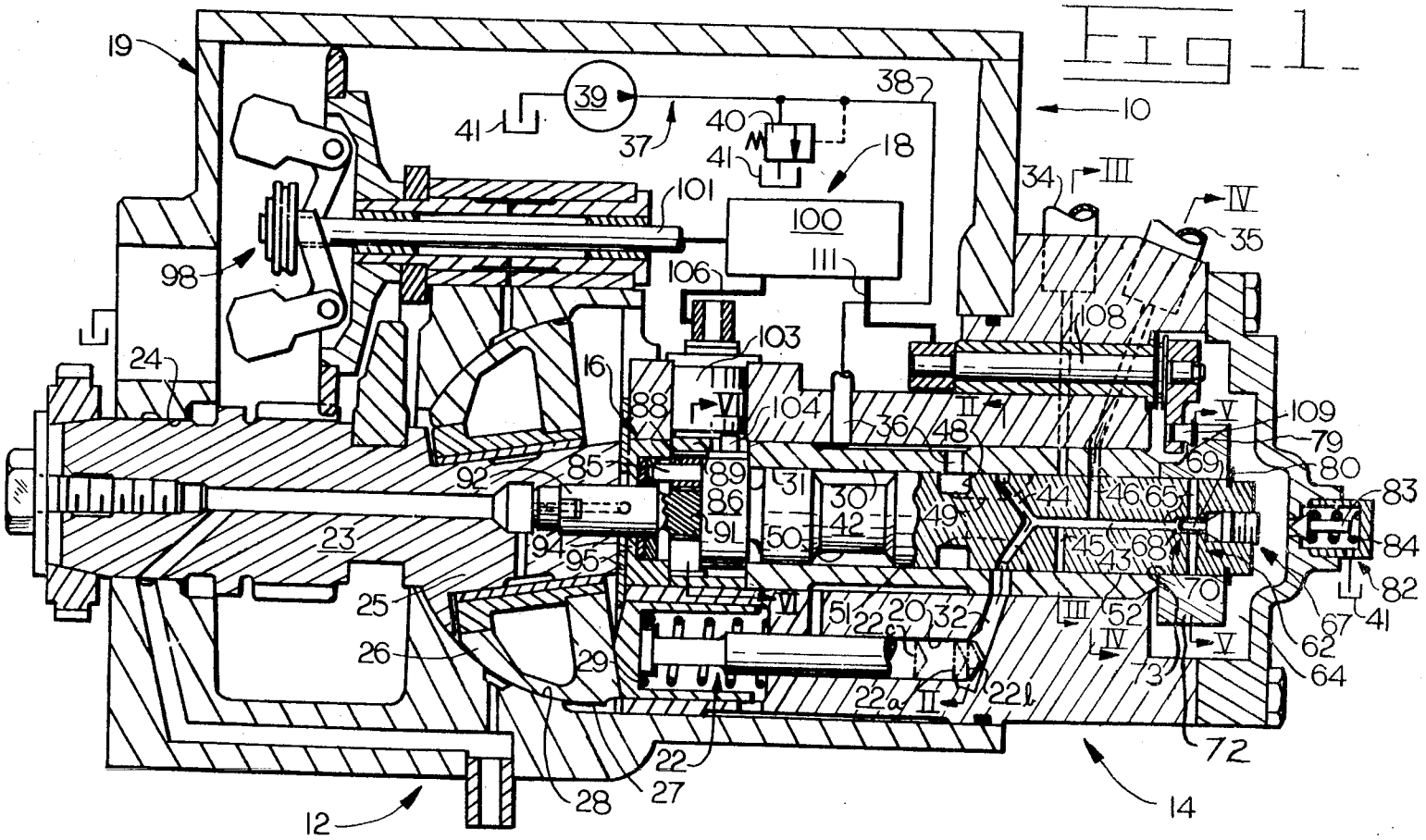
FIG. 1 is a partial schematic and sectional view of an embodiment of the present invention.
Figure 2:
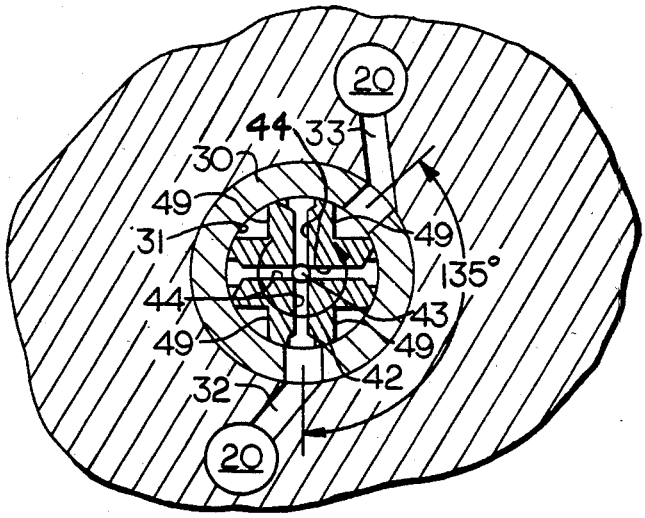
FIG. 2 is a somewhat enlarged sectional view taken along line II—II of FIG. 1.

Referring now to FIG. 1, a fuel injection system is generally indicated by the reference numeral 10 and includes a source of pressurized fluid, such as, a pumping section 12, a distribution valve 14, a planetary gear arrangement 16 driven by the pumping section 12 and drivingly connected to the distribution valve 14, and a governor section 18 all contained within a common multipiece housing assembly 19.

The pumping section 12 is of the nutating type and includes a pair of pumping chambers 20 (only one of which is shown in FIG. 1) defined in the housing assembly 19, and a pair of plunger assemblies 22 (only one of which is shown in FIG. 1) each reciprocatably disposed in the respecting pumping chamber 20. The plunger assembly 22 as shown in FIG. 1 is illustrated in three different operating positions *22a,22b,22c*. The pumping section 12 also includes a drive shaft 23 suitably journalled within a bore 24 of the housing assembly 19. An angled eccentric portion 25 is formed on the drive shaft 23 and has a nutating member 26 journalled on the eccentric portion 25. The nutating member 26 has a spherical surface 27 seated in a mating concave spherical bearing surface 28 defined by the housing assembly 19. A spring 29 resiliently urges each of the plunger assemblies 22 into intimate contact with the nutating member 26.

Referring now to FIGS. 2–7 in conjunction with FIG. 1, the distribution valve 14 includes a sleeve 30 rigidly disposed in the housing assembly 19 and defining a bore 31. First and second delivery passages 32,33 respectively communicate the pumping chambers 20 with the bore 31. The delivery passages 32,33 communicate with the bore 31 at points arcuately spaced 135° apart. A first and second plurality of distributor passages 34,35 communicate with the bore 31 in separate axially spaced planes and are connectable to the cylinder combustion chambers of an engine (not shown) in the usual manner. A passageway 36 (FIGS. 1 and 6) communicates with the bore 31 and is connected to a low pressure zone 37 by a conduit 38. The low pressure zone 37 includes, for example, a fuel transfer pump 39, a relief valve 40, and a fuel tank 41.

A rotor 42 is rotatably positioned within the bore 31 and has an axial passage 43 selectively communicatable with the first and second delivery passages 32,33 through a plurality of inlet ports 44 in a predetermined timed pattern. A pair of outlet ports 45,46 in the rotor 42 selectively communicates the axial passage 43 with the respective first and second plurality of distributor passages 34,35.

A first annular groove 48 formed in the rotor 42 is in continuous communication with the passageway 36 of the housing assembly 19. A plurality of axial slots 49 formed in the distributor rotor 42 selectively communicate the first annular groove 48 with the first and second delivery passages 32,33. A second annular groove 50 is formed in the rotor 42 and is axially spaced on the rotor 42 from the first annular groove 48 in a direction opposite to that of the first and second outlet ports 45,46. A land 51 is defined on the rotor 42 between the first and second annular grooves 48,50.

Figure 5:
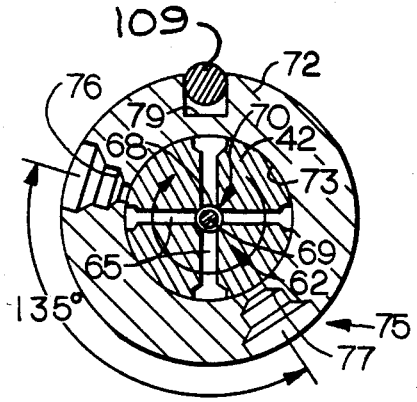
FIG. 5 is a somewhat enlarged sectional view taken along line V—V of FIG. 1.
Figure 6:
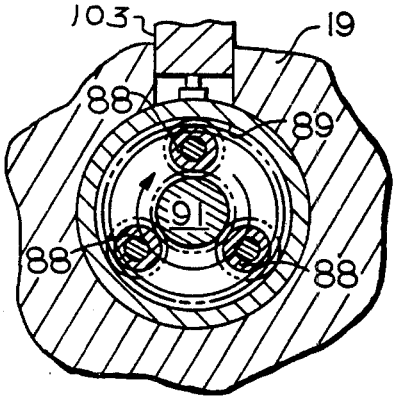
FIG. 6 is a somewhat enlarged sectional view taken along line VI—VI of FIG. 1.

A bypass port means 62 is provided in the rotor for communicating the axial passage 43 to a low pressure chamber 64 in the housing assembly 19. The bypass port means 62 includes a bypass port 65 communicating the axial passage 43 with the peripheral surface 52. As shown in FIG. 5, the bypass port 65 includes two cross drilled holes opening to the peripheral surface 52 of the rotor 42 at four equally spaced points.

A means 67 is provided in the rotor for restricting the flow of fluid from the axial passage 43 to the low pressure chamber 64. The restricting means 67 includes an opening 68 of a predetermined cross-sectional area located in the bypass port 65 and a member 69 of a smaller predetermined cross-sectional area disposed in the opening 68 to establish a fixed orifice 70 of a predetermined size.

A bypass collar 72 defining a bore 73 is disposed about a portion of the rotor 42 and adapted to allow relative rotation between the rotor 42 and the collar 72. As more clearly shown in FIG. 5, spill passage means 75 is provided for selectively communicating the bypass port means 62 of the rotor 42 with a low pressure chamber 64. The spill passage means 75 includes first and second spill passages 76,77 communicating the bore 73 of the collar 72 with the low pressure chamber 64. The spill passages 76,77 communicate with the bore 73 at points arcuately spaced 135° apart. The collar 72 further defines a slot 79 therein opening to the peripheral surface of the collar 72. The collar 72 is axially retained on the rotor 42 between a portion of the housing assembly 19 and a lock ring 80.

A means 82 is provided for controlling the pressure level of the fluid in the low pressure chamber 64. The controlling means 82 includes a relief valve poppet 83 located between the low pressure chamber 64 and the fuel tank 41. A spring 84 biases the poppet 83 closed in a conventional manner.

The planetary gear arrangement 16 includes a plurality of carrier pins 85 connected to and extending axially from an end portion 86 of the rotor 42. Each of the carrier pins 85 rotatably carry a planet gear 88 which meshes with a ring gear 89 and a sun gear 91. The sun gear 91 is integrally connected to the drive shaft 23 by a shaft 92. The end of the carrier pins 85 extend to and support an annular thrust bearing assembly 94 which abuts a plate 95 suitably secured to the housing assembly 19.

The governing section 18 includes a flyweight assembly 98 responsive to the speed of the drive shaft 23 of the pumping section 12 and hence to the speed of the engine to which the fuel distribution system 10 is connected. A governor control 100 is operatively connected to the flyweight assembly 98 by a shaft 101.

A control shaft 103 has an eccentric projection 104 extending therefrom and in mating contact with the ring gear 89. The governor control 100 is operatively connected to the control shaft 103 by any suitable operating mechanism 106. A control shaft 108 has an eccentric projection 109 extending therefrom and in mating engagement with the slot 79 of the collar 72. A suitable operating mechanism 111 connects the output of the governor control 100 to the control shaft 108.

INDUSTRIAL APPLICABILITY

In the use of a fuel distribution system of this type, the pumping section 12 delivers fuel from the pumping chambers 20 to the respective delivery passage 32,33. As illustrated in FIG. 1, the pumping section 12 is a nutating pump. It is recognized that various forms of pumps could be used, however, the nutating pump offers compactness and the capability of producing operating system pressures well beyond 55,000 kPa (7,980 psi).

During rotation of the drive shaft 23, each of the plunger assemblies move within its respective pumping chamber 20. The postion 22*c* of the plunger 22 shown in FIG. 1 represents the postion at which the pumping chamber 20 is full of fuel. The position 22*b* represents the position at which all of the fuel from the pumping chamber 20 has been expelled. The position 22*a* generally represents the position of the plunger assembly 22 at one of the points when fuel is being directed to one of the cylinder combustion chambers. FIGS. 1–5 all represent the system during injection of fuel to one of the cylinder combustion chambers.

Figure 4:
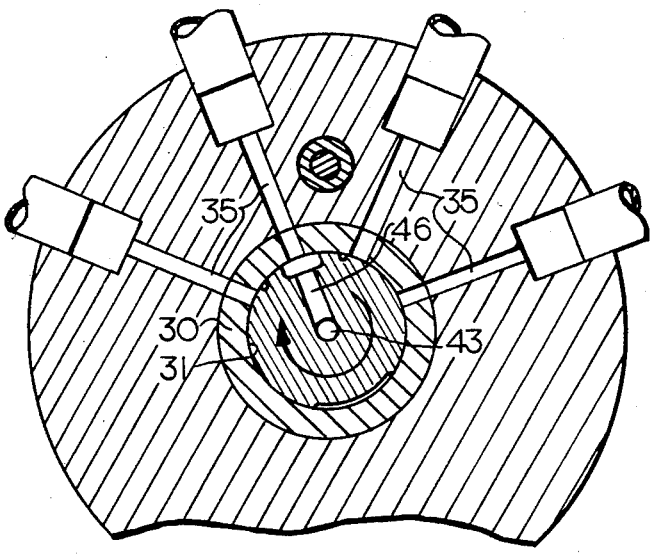
FIG. 4 is a somewhat enlarged sectional view taken along line IV—IV of FIG. 1.

The pressurized fluid in the delivery passage 32 enters one of the inlet ports 44 of the rotor 42 and communicates with the axial passage 43. The pressurized fluid from the axial passage 43 cooperates with the outlet port 46 and is injected into one of the cylinder combustion chambers (not shown) through the respective distributor passage 35 as shown in FIG. 4. At the illustrated position of the rotor 42, all of the pressurized fluid from the delivery passage 32 is being directed to the cylinder combustion chamber in the engine through one of the delivery passages 35.

From a review of FIG. 5, it is noted that additional rotation of the rotor 42 in the direction illustrated by the arrow results in the communication of the bypass port 65 with the spill passage 76. Since the bypass port 65 is in communication with the axial passage 43, the pressurized fluid in the axial passage 43 bypasses to the low pressure chamber 64 through the spill passage 76. The bypassed fuel in the low pressure chamber 64 is directed to fuel tank 41 across the relief valve poppet 83. This additional rotor rotation and the subsequent bypassing of fuel through the fixed orifice 70 located in the bypass port 65 and the spill passage 76 ends the injection of fuel to the cylinder combustion chamber in the engine.

The additional fuel being delivered from the pumping chamber 20 is directed through the spill passage 76 until rotation of the rotor 42 opens communication of the delivery passage 32 with one of the axial slots 49. The fuel being bypassed to the one axial slot 49 returns to fuel tank 41 through the passageway 36, the conduit 38, and the relief valve 40. As noted from a closer review of FIGS. 2 and 5, the bypass port 65 opens to the spill passage 76 prior to the delivery passage 32 opening to the slot 49. It is recognized that the timing on the rotor 42 could be altered such that the communication of the bypass port 65 with the spill passage 76 and the communication of the delivery passage 32 with the axial slots 49 could occur simultaneously or at various other intervals.

As the rotor 42 rotates further, the communication between the delivery passage 32 and the inlet port 44 is interrupted. Substantially simultaneously the pumping plunger 22 is at the end of the pumping stroke, as illustrated in FIG. 1 at the end of stroke postion 22*b*. At this time interval, the other pumping plunger 20 is in the full fill position 22*c*. As the pumping plunger 20, shown in FIG. 1, retracts towards the full fill position 22*c*, the pumping chamber 20 fills with fuel delivered from the fuel transfer pump 39. As shown in FIG. 1, the fuel from the pump 39 is directed through the conduit 38, the passageway 36, the first annular groove 48, one of the axial slots 49, and the delivery passage 32 to the pumping chamber 20. The relief valve 40 controls the pressure level of the fuel from the pump 39 to approximately 275 kPa (40 psi).

During the filling of the pumping chamber 20, shown in FIG. 1, the other pumping plunger 22 is delivering pressurized fuel to the other delivery passage 33. At the start of this delivery stroke, the delivery passage 33 is in simultaneous communication with one of the inlet ports 44 of the rotor and one of the axial slots 49. Since the one axial slot 49 is in communication with the tank 41 through the relief valve 40, all of the fuel will be bypassing or "spilling" to tank 41 across the one axial slot 49. Even though the fuel in the delivery passage 33 is open to one of the distributor passages 34 through the inlet port 44, the axial passage 43, and the outlet port 45, the fuel takes the path of least resistance which is through the relief valve 40. As the rotor 42 rotates further, the axial slot 49 is blocked from the delivery passage 43. This is the point at which injection of fuel to the cylinder combustion chamber starts. Injection continues until the bypass port 65 opens to the spill passages 77.

Figure 3:
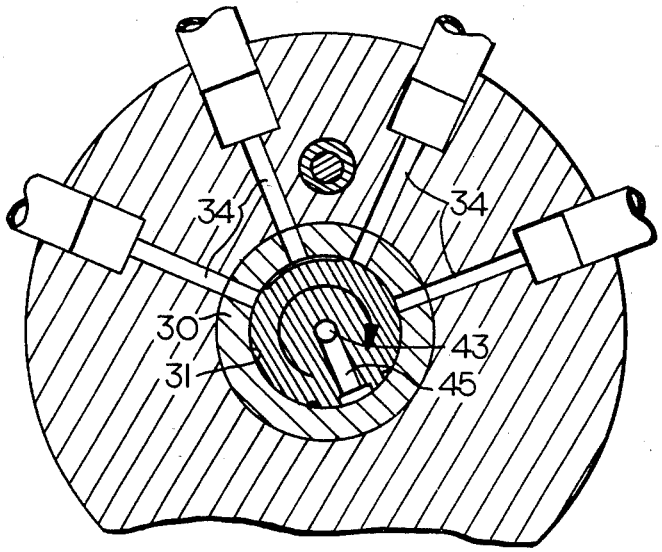
FIG. 3 is a somewhat enlarged sectional view taken along line III—III of FIG. 1.

As illustrated in FIGS. 3 and 4, the subject design is functional for an engine having eight cylinders. Furthermore, it is quite obvious that there are only two pumping plungers 22 in the pumping section 12 and four inlet ports 44 in the rotor 42. Therefore, it is necessary that the drive shaft 23 rotates at a faster rate than the rotor 42. The planetary gear arrangement 16 privides a 4:1 reduction between the rotary speed of the pumping section 12 and the rotor 42. Consequently, each of the plunger assemblies 22 makes four complete pumping strokes to each complete revolution of the rotor 42. Furthermore each of the inlet ports 44 of the rotor 42 receives fluid from both of the respective delivery passage 32,33 during each complete revolution of the rotor 42. In order to achieve the needed 45° arc of rotation for each injection, the delivery passages 32,33 open to the bore 31 at points arcuately spaced 135° apart while the four inlet ports 44 open to the peripheral surface 52 of the rotor 42 evenly spaced 90° apart. The same timing relationship is also needed between the collar 72 and the rotor 42. Consequently the spill passages 76,77 open to the bore 73 at points arcuately spaced 135° apart and the four bypass ports 65 open to the peripheral surface of the rotor 42 evenly spaced 90° apart.

In this arrangement, the product of the number of bypass ports 65 opening to the peripheral surface 52 of the rotor 42 and the number of spill passages 76,77 of the collar 72 equals the number of cylinders in the engine. The following table further illustrates this principle relative to different engines with different number of cylinders.

| No. of Engine Cylinders | No. of Pump Plungers | No. of Spill Passages | Spill Passage Spacing | No. of Bypass Ports |
|---|---|---|---|---|
| 2 | 1 | 2 | Evenly Spaced | 1 |
| 4 | 1 | 4 | Evenly Spaced | 1 |
| 8 | 2 | 2 | 135°–225° | 4 |
| 12 | 3 | 3 | Evenly Spaced | 4 |
| 6 | 3 | 3 | Evenly Spaced | 2 |
| 3 | 1 | 3 | Evenly Spaced | 1 |
| 5 | 1 | 5 | Evenly Spaced | 1 |

In order to control the start of injection with respect to the engine operation, the postion of the inlet ports 44 of the rotor 42 must be adjusted or timed with respect to the delivery passages 32,33. This is accomplished by controllably rotating the ring gear 89 of the planetary gear arrangement 16. The rotation of the ring gear 89 with respect to the sun gear 91 alters the angular postion of the rotor 42 with respect to the drive shaft 23, thus altering the start of injection. The ring gear 89 is controllably rotated in response to the governor control 100 through the operating mechanism 106, the control shaft 103, and the eccentric projection 104.

The end of injection is controlled by controllably rotating the collar 72 with respect to the rotor 42. The collar 72 is rotated in response to the governor control 100 through the operating mechanism 111, the control shaft 108, and the eccentric projection 109.

The governor control 100 receives an input signal representative of the engine RPM from the flyweight assembly 98. The governor control 100 controllably adjusts the start of injection and the end of injection to provide the needed quantities of fuel to the respective cylinder combustion chambers of the engine.

Controlling cavitation in a high pressure fuel system is always very important since any formation of voids and/or gas bubbles hampers the injection of fuel to the respective cylinder combustion chambers. The fixed orifice 70 in the bypass port 65 of the rotor 42 provides control of cavitation in the system at the end of injection when fuel is being bypassed through the low pressure chamber 64 to the tank 41. By having the orifice 70 located in the bypass port 65, the rate of fuel flow from the axial passage 43 and the outlet port 45,46 to the low pressure chamber 64 is controlled. By controlling the rate of fuel flow through the bypass port 65, the rate at which the pressure drops is likewise controlled.

The low pressure chamber 64 functions to control the size of any remaining air bubbles and substantially eliminates any voids that may remain. The pressure level of the fuel in the low pressure chamber is normally selected from the range of 400 kPa (58 psi) to 1550 kPa (217 psi).

Since there is no known method of totally eliminating the creation of cavitation in the collar metered configuration, it is important to control the size of the remaining bubbles and/or voids. As the bypass opens, the sudden rush of fuel flow to the low pressure chamber 64 is controlled by the orifice 70. Even though the flow is being controlled, some cavitation still exists. The pressure level in the rotor 42 reduces as the fuel in the rotor is being bypassed to the low pressure chamber 64. Once the pressure in the rotor 42 reduces, below the pressure in the low pressure chamber 64, a reverse flow takes place from the low pressure chamber 64 to the rotor 42 resulting in the filling of previously developed voids and the flushing and/or compression of any entrained air bubbles. It should be noted that this all happens in a very short time interval prior to closing of communication between the bypass port 65 and the spill passage 76/77.

In view of the foregoing, it is readily apparent that the distribution valve 14 shown and described herein provides an end of injection bypass arrangement which controls the rate of bypass flow thus effectively reducing cavitation in the fuel system. The orifice 70 in the bypass port 65 is effective to control the rate of bypass flow while the low pressure chamber 64 provides the source of pressurized fuel to flush and/or compress any entrained gas bubbles in the rotor 42 prior to the next injection stroke.

Other aspects, objects and advantages of this invention can be obtained from a study of the drawings, the disclosure and the appended claims.

We claim:

1. In a distribution valve (14) having a housing (19) defining a bore (31) and a plurality of distributor passages (34/36) in communication with the bore (31); a rotor (42) located in the bore (31) and adapted to rotate, said rotor (31) having a peripheral surface (52), an axial passage (43) located therein adapted for selective communication with a source (12) of pressurized fluid, an outlet port (45/46) communicating with the axial passage (43) and adapted for selective communication with each of the plurality of distributor passages (34/35), and bypass port means (62) communicating with the axial passage (43) and exiting on the peripheral surface (52) of the rotor (42); a bypass collar (72) disposed about a portion of the rotor (42) and having spill passage means (75) for selectively communicating the bypass port means (62) of said rotor (42) with a low pressure chamber (64), said bypass collar (72) being adjustably restrained from rotation relative to said rotor (42), the improvement comprising:

means (67) for continuously restricting at all times during fluid bypass the flow of fluid from the axial passage (43) to the low pressure chamber (64); and means (82) for controlling the pressure level of pressurized fluid in said low pressure chamber (64) to a predetermined level above atmospheric pressure, said controlling means being located between the low pressure chamber and a fluid reservoir.

2. The distribution valve, as set forth in claim 1, wherein said predetermined pressure level is taken from a range of 400 kPa to 1500 kPa.

3. The distribution valve, as set forth in claim 1, wherein said restricting means is a fixed orifice located in the bypass port means of the rotor.

4. The distribution valve, as set forth in claim 3, wherein said distribution valve is driven by an engine having a plurality of cylinders adapted to respectively receive fluid from the plurality of distributor ports, said bypass port means including at least one bypass port, and said spill passage means includes at least one spill passage, and the product of the number of bypass ports and the spill passages equals the number of cylinders in the engine.

5. The distribution valve, as set forth in claim 4, wherein the fixed orifice is defined by an opening of a predetermined cross-sectional area and a member of a smaller predetermined area disposed in said opening and secured to said rotor, said opening being located in the bypass port means.

6. The distribution valve, as set forth in claim 3, wherein said bypass port means includes at least one bypass port.

7. The distribution valve, as set forth in claim 6, wherein said bypass port means includes four equally spaced bypass ports exiting on the peripheral surface of the rotor.

8. The distribution valve, as set forth in claim 7, wherein said bypass collar has a bore slideably disposed about the peripheral surface of the rotor, said spill passage means includes two spill passages each intersecting said bore of the collar and opening into said low pressure chamber, each of said spill passages selectively communicate with the four bypass ports of the rotor in response to rotation of said rotor.

9. The distribution valve, as set forth in claim 8, wherein the two spill passages of said collar intersect the bore of said collar at points arcuately spaced 135° apart.

* * * * *